US006572671B1

(12) United States Patent
Baazi et al.

(10) Patent No.: US 6,572,671 B1
(45) **Date of Patent: *Jun. 3, 2003**

(54) ADDITION OF H-BN IN STAINLESS STEEL POWDER METALLURGY

(75) Inventors: Tandjaoui Baazi, Sainte-Foy (CA); Roch Angers, Sainte-Foy (CA); Danielle Lacombe, Sainte-Foy (CA)

(73) Assignee: Maxtech Manufacturing Inc, Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/635,074

(22) Filed: Aug. 9, 2000

Related U.S. Application Data

(63) Continuation-in-part of application No. 09/316,384, filed on May 21, 1999, now Pat. No. 6,103,185.

(51) Int. Cl.[7] ..... B22F 3/12; B22F 3/16; C22C 33/02

(52) U.S. Cl. ..... 75/244; 75/231; 419/12; 419/13; 419/38

(58) Field of Search ..... 75/231, 244; 419/12, 419/13, 38

(56) References Cited

U.S. PATENT DOCUMENTS 4,032,336 A 6/1977 Reen
6,103,185 A * 8/2000 Baazi et al. ..... 419/2

FOREIGN PATENT DOCUMENTS

GB 2 307 917 6/1997
JP 01-129903 5/1989

OTHER PUBLICATIONS

ASM Handbook, vol. 7, Powder Metallurgy, pp. 704 to 709.

Velasco F. et al.: "Mechanical and corrosion behaviour . . . ", Materials Science and Technology, vol. 13, No. 10, Oct. 1997, pp. 847–851.

Klar E. et al.: "Powder metallurgy stainless steels", Metals Handbook, US, Metals Park, ASM, 10th ed., vol. 7, pp. 774–785.

* cited by examiner

*Primary Examiner*—Daniel J. Jenkins
(74) *Attorney, Agent, or Firm*—R. Craig Armstrong; Borden Ladner Gervais LLP

(57) ABSTRACT

In the invention, a stainless steel powder of the desired composition is either directly mixed with a h-BN powder, compressed and sintered or the stainless steel powder is compressed, impregnated with a solution containing h-BN and then sintered or compressed, sintered and then impregnated with a solution containing h-BN. The sintered bodies in all the aforementioned cases may be resin impregnated. Steel body formation may be done by traditional press compacting or, alternatively, by injection molding steel powder in molds (metal injection molding, MIM).

50 Claims, 13 Drawing Sheets

316L X 200

316L + 0.75% h-BN X 200

316L +1% h-BN X 200

409Cb + 1% h-BN X 50

Carbon steel + 1% h-BN X 100

ADDITION OF H-BN IN STAINLESS STEEL POWDER METALLURGY

REFERENCE TO RELATED APPLICATION

This is a continuation-in-part of application Ser. No. 09/316,384, filed May 21, 1999, now U.S. Pat. No. 6,103,185.

BACKGROUND OF THE INVENTION

1. Field of the Invention

This invention relates to powder metallurgically formed steels, and particularly to such steels having enhanced corrosion resistance, and more particularly to h-BN (hexagonal boron nitride) additions to such steels to accomplish enhanced corrosion resistance as well as increased hardness, tensile strength, free machining properties, tightness and surface density. In particular, stainless steels of both austenitic and ferritic type are especially suitable for being produced using a method according to the invention. Powder metallurgy will be referred to as P/M henceforth.

2. Description of the Prior Art

A sintered stainless steel is known where an addition of boron is made to improve the corrosion resistance and the mechanical properties, for example from U.S. Pat. No. 4,032,336 (Reen) which is hereby incorporated as reference. Improved corrosion resistance and improved mechanical properties are due to increase in density. The boron forms a liquid phase during sintering, depleting chromium and molybdenum from the steel powder. The steel powder therefore contains sufficient amount of Cr and Mo to offset this depletion which results in the sintered non-melted parts of the product being within the required composition for a specific austenitic stainless steel. Boron is added to the base material to obtain a pre-alloyed metallic powder which (according to the ASTM handbook Volume 7 p.9) is a metallic powder composed of two or more elements that are alloyed during the powder manufacturing process, and in which the particles are of the same nominal composition throughout.

The raw material thus contains an elevated amount of Cr and Mo, which adds to the cost of the raw material.

According to JP 01-129903 (Wataru), of which the JAPIO English abstract is hereby incorporated by reference, hexagonal boron nitride (h-BN) is mixed with a metallic powder (preferably an iron alloy containing Co, Ni, Cr, etc.). The purpose of adding h-BN to the metal powder is to enable compaction without using an organic lubricating agent, thus utilizing h-BN as a lubricating agent.

SUMMARY OF THE INVENTION

It is an object of the invention to provide sintered steels and a method for making steels which contain standard or lower than standard amounts of alloying elements such as Cr, Mo and Ni, but which still exhibit a superior resistance to corrosion as well as increased hardness, tensile strength, free machining properties, tightness and surface density.

In the invention, a steel powder of the desired composition is either directly mixed with a h-BN powder, compressed and then sintered or the steel powder is compressed, impregnated with a solution containing h-BN and then sintered or the steel powder is compressed, sintered and then impregnated with a solution containing h-BN.

Alternatively, steel body formation may be performed by injection molding steel powder in molds (metal injection molding, MIM, also known as powder injection molding). Thus, a steel powder of the desired composition is either directly mixed with a h-BN powder, metal injection molded and then sintered or the steel powder is metal injection molded, impregnated with a solution containing h-BN and then sintered or the steel powder is metal injection molded, pre-sintered, impregnated with a solution containing h-BN and then sintered or, alternatively, the steel powder is metal injection molded, sintered and then impregnated with a solution containing h-BN.

A first method of producing sintered steel bodies according to the invention comprises the steps of:

a) Adding h-BN powder to, and mixing with, a steel powder, preferably a stainless steel powder, in the weight percentage range 0.1 to 2%, more preferably 0.7 to 1%.

b) Compacting the mixed steel powder/h-BN powder using a pressure, preferably in the range of 20–60 tsi, to form green bodies. The unit tsi is converted to MPa by multiplying with 13.793 (or 2000/145), thus the pressure range is approximately 276–828 MPa.

c) Sintering the green bodies to produce sintered steel bodies, preferably at a sintering temperature range of 2000° F. (1093° C.)–2500° F. (1371° C.) and for a time of between 15–60 minutes. The sintering step is preferably performed in an atmosphere comprising a mixture of hydrogen and nitrogen.

Alternatively, step b) above may be performed using metal injection molding techniques:

a) Adding h-BN powder to, and mixing with, a steel powder, preferably a stainless steel powder, in the weight percentage range 0.1 to 2%, more preferably 0.7 to 1%, together with a binding mixture, preferably an organic binding mixture.

b) Compacting the mixed steel powder/h-BN powder using MIM.

c) Removing the binder from the green bodies, for example by heating to vaporize the binder.

d) Sintering the green bodies to produce sintered steel bodies, preferably at a sintering temperature range of 2000° F. (1093° C.)–2500° F. (1371° C.) and for a time of between 15–60 minutes. The sintering step is preferably performed in an atmosphere comprising a mixture of hydrogen and nitrogen.

A second method of producing sintered steel bodies according to the invention comprises the steps of:

a) Compacting steel powder, preferably a stainless steel powder, using a pressure, preferably in the range of 20–60 tsi (276–828 MPa), to form green bodies.

b) Impregnating the green bodies with a solution containing h-BN.

c) Sintering the impregnated green bodies, preferably at a sintering temperature range of 2000° F. (1093° C.)–2500° F. (1371° C.) and for a time of between 15–60 minutes. The sintering step is preferably performed in an atmosphere comprising a mixture of hydrogen and nitrogen.

Alternatively, step a) above may be performed using metal injection molding techniques:

a) Compacting steel powder, preferably a stainless steel powder, together with a binder, preferably an organic binder, using MIM, and removing the binder from the green bodies, for example by pre-sintering heating to vaporize/remove the binder.

b) Impregnating the green/pre-sintered bodies with a solution containing h-BN.

c) Sintering the impregnated green/pre-sintered bodies, preferably at a sintering temperature range of 2000° F. (1093° C.)–2500° F. (1371° C.) and for a time of between 15–60 minutes. The sintering step is preferably performed in an atmosphere comprising a mixture of hydrogen and nitrogen.

If the binder is left in the green bodies during the impregnating step, the binder will be removed by the heat during the sintering step. This is useful only for binders which do not impede the impregnating step or adversely affect the impregnation effect during sintering. An optional step of pre-sintering the green bodies is preferably performed between steps a) and b) above.

A third method of producing sintered steel bodies according to the invention comprises the steps of:

a) Compacting steel powder, preferably a stainless steel powder, using a pressure, preferably in the range of 20–60 tsi (276–828 MPa), to form green bodies.

b) Sintering the green bodies, preferably at a sintering temperature range of 2000° F. (1093° C.)–2500° F. (1371° C.) and for a time of between 15–60 minutes. The sintering step is preferably performed in an atmosphere comprising a mixture of hydrogen and nitrogen.

c) Impregnating the sintered bodies with a solution containing h-BN.

Alternatively, step a) above may be performed using metal injection molding techniques:

a) Compacting steel powder, preferably a stainless steel powder, together with a binder, preferably an organic binder, using MIM, and optionally removing the binder from the green bodies, for example by heating to vaporize the binder.

b) Sintering the green bodies, preferably at a sintering temperature range of 2000° F. (1093° C.)–2500° F. (1371° C.) and for a time of between 15–60 minutes. The sintering step is preferably performed in an atmosphere comprising a mixture of hydrogen and nitrogen.

c) Impregnating the sintered bodies with a solution containing h-BN.

The product of the method according to the invention is thus a sintered steel, preferably a stainless steel, having a composition of essentially iron, and possible alloying elements such as chromium, molybdenum and nickel, together with 0.1 to 2% h-BN, preferably 0.7 to 1% h-BN.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Three methods according to the invention of introducing h-BN into P/M steel will be further described: pre-sintering impregnation, post-sintering impregnation and h-BN powder mixing with steel powder. Steel body formation may be done by traditional press compacting or, alternatively, by injection molding steel powder in molds (metal injection molding, MIM). In all cases of the description below, the compacting step can be performed using MIM. If MIM is used, any binder mixture utilized will have to be removed before pre-sintering impregnation. MIM is also called Powder Injection Molding.

Pre-sintering Impregnation

Green parts, i.e. compacted powder parts, of steel may be impregnated with a solution containing h-BN. This is referred to as pre-sintering impregnation. Pre-sintering impregnation with h-BN may be followed or not by resin impregnation after the sintering operation.

EXAMPLE A 316L type austenitic stainless steel green bodies were impregnated with a solution containing h-BN. The method of making the sintered bodies of stainless steel includes the following steps:

a) Forming powder bodies of stainless steel powder mixed with a lubricant according to conventional methods.

b) Compacting the powder bodies using a pressure in the range of 20–60 tsi (276–828 MPa) to produce green bodies.

c) Impregnating the green bodies with a solution containing h-BN.

d) Sintering the impregnated green bodies in a Hydrogen-Nitrogen atmosphere. The sintering temperature range was 2000° F. (1093° C.)–2400° F. (1316° C.) and the sintering time was 15 to 60 minutes.

Figure 1:
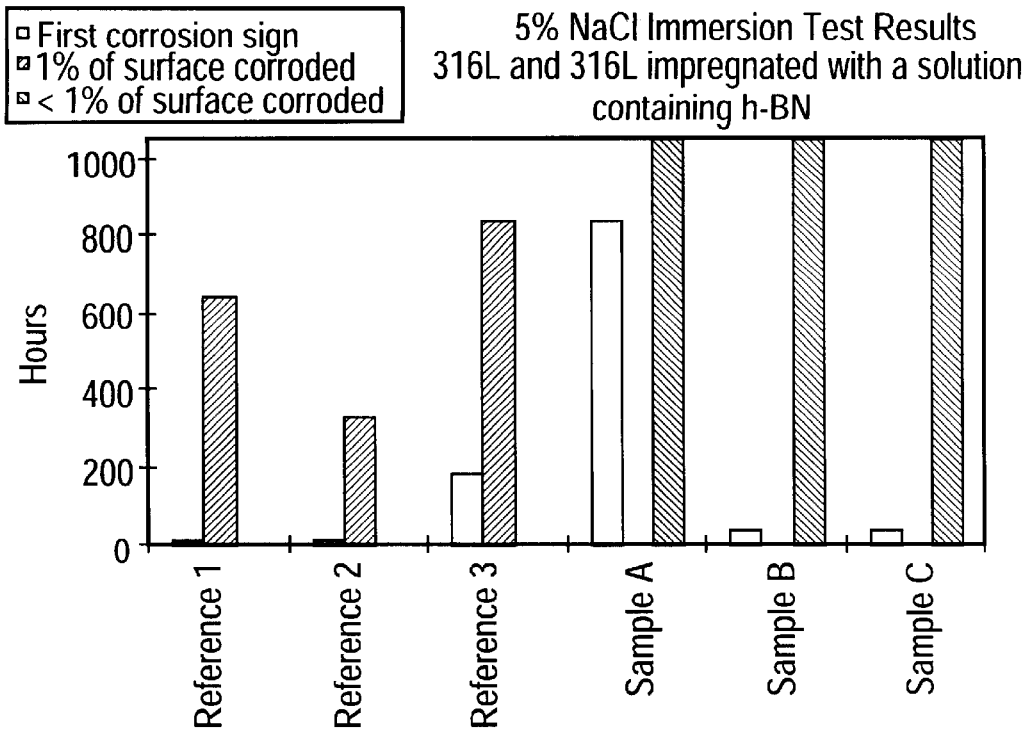
FIG. 1 is a diagram showing the results of a corrosion test, after 1000 hours, on 316L P/M stainless steels impregnated with h-BN and then sintered, according to the invention, together with sintered stainless steels containing no h-BN and referred to as reference steels henceforth.
Figure 2:
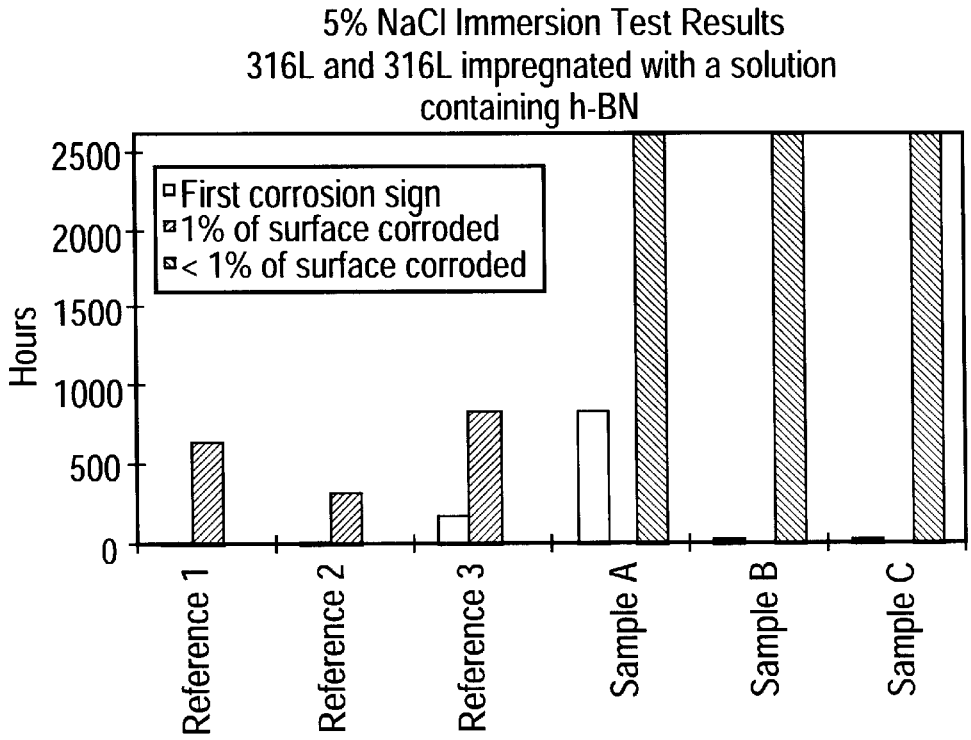
FIG. 2 is a diagram showing the results of a corrosion test, after 2500 hours, on 316L P/M stainless steels impregnated with h-BN and then sintered, according to the invention, together with reference steels.
Figure 3:
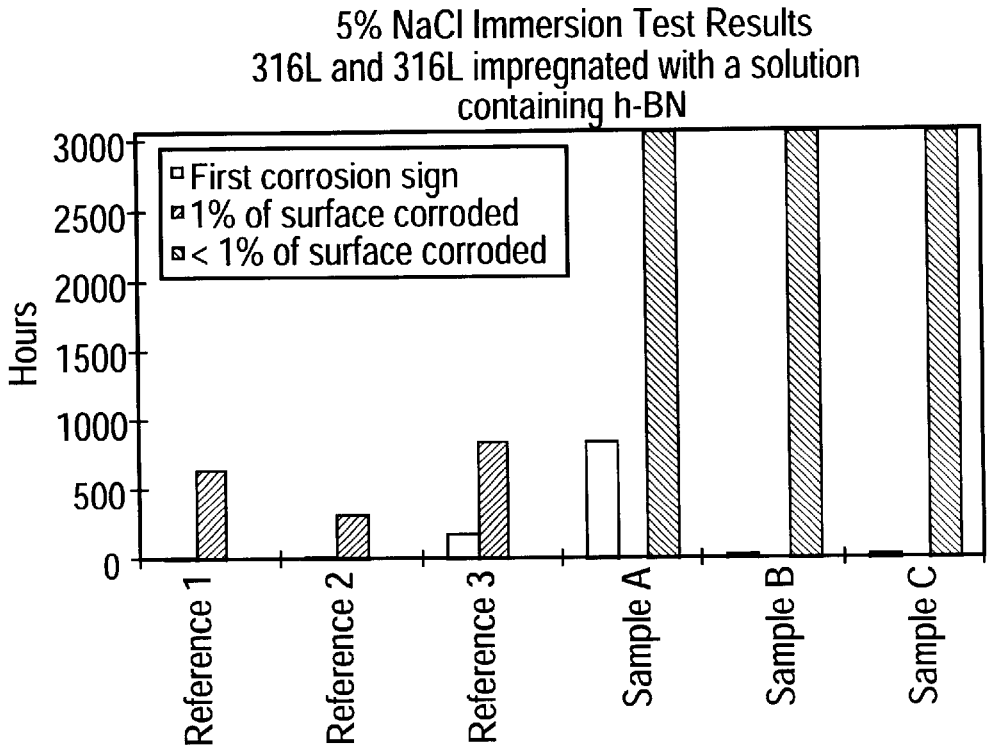
FIG. 3 is a diagram showing the results of a corrosion test, after 3000 hours, on 316L P/M stainless steels impregnated with h-BN and then sintered, according to the invention, together with reference steels.

The corrosion resistance was tested by a 5% NaCl Immersion Test, and the results are shown in FIGS. 1 to 3.

As is evident from FIGS. 1 to 3, the three samples of a P/M stainless steel according to the invention (samples A, B and C) all exhibit better corrosion resistance compared to the three references (P/M stainless steels without the h-BN impregnation). The corrosion resistance results are shown after 1000 hours, 2500 hours and 3000 hours, respectively, in FIGS. 1 to 3. The samples A, B and C, which were sintered stainless steels according to the invention, had less than 1% of corroded surface even after 3000 hours of testing, while all reference samples reached 1% of corroded surface before 1000 hours were up.

Post-sintering Impregnation

Alternatively, already sintered bodies of steel may be impregnated with a solution containing h-BN. This is referred to as post-sintering impregnation. Post-sintering impregnation with h-BN may be done with or without resin impregnation. The method of making the sintered bodies of steel includes the following steps:

a) Forming powder bodies of steel powder mixed with lubricant according to conventional methods.

b) Compacting the powder bodies using a pressure in the range of 20–60 tsi (276–828 MPa) to produce green bodies.

c) Sintering the green bodies. The sintering temperature range was 2200° F. (1204° C.)–2400° F. (1316° C.) and the sintering time was 15 to 60 minutes.

d) Impregnating the sintered bodies with a solution containing h-BN.

The impregnated sintered bodies exhibit less porosity than the sintered bodies, which enhances the corrosion resistance. To achieve further improvements in corrosion resistance, the impregnated bodies are heated to cause a chemical reaction between the h-BN and the steel. The heating can be at low temperatures, 100 to 300° C. or more preferably 150 to 200° C., or at ordinary sintering temperatures, as long as the chemical reaction takes place or, at least, the water content of the h-BN solution is lowered.

Mixing h-BN Powder and Stainless Steel Powder

The third alternative is mixing h-BN powder with the steel powder before compacting and sintering. Resin impregnation is optional also in this case.

EXAMPLE B

Commercial 316L type austenitic stainless steel powder was mixed with commercial h-BN powder. The method of making the sintered bodies of stainless steel included the following steps:

a) A commercial h-BN powder was added to, and mixed with a commercial stainless steel powder, in the weight percentage range 0–1%. All percentages used in this text are weight percent, unless otherwise specified.

b) Powder bodies were compacted using a pressure in the range of 20–60 tsi (276–828 MPa) to form green bodies.

c) The green bodies were sintered in a Hydrogen-Nitrogen atmosphere. The sintering temperature range was 2200° F. (1204° C.)–2400° F. (1316° C.) and the sintering time was 15 to 60 minutes.

According to the MPIF Standard, the 316L austenitic stainless steel should have the composition listed in Table 1. Hence, in the case of mixing h-BN powder to the SS-316L powder, the end product remains within the composition range of the MPIF 316L standard.

TABLE 1

| Element | C | Cr | Ni | Mo | Mn | Si | P | S | N | Fe |
|---|---|---|---|---|---|---|---|---|---|---|
| Minimum | 0.0 | 16 | 10 | 2.0 | 0.0 | 0.0 | 0.0 | 0.0 | 0.00 | Bal. |
| Maximum | 0.03 | 18 | 14 | 3.0 | 2.0 | 1.0 | 0.045 | 0.03 | 0.03 | Bal. |

Other elements: Total by difference equals 2.0% maximum which may include other minor elements added for specific purposes.

Figure 4:
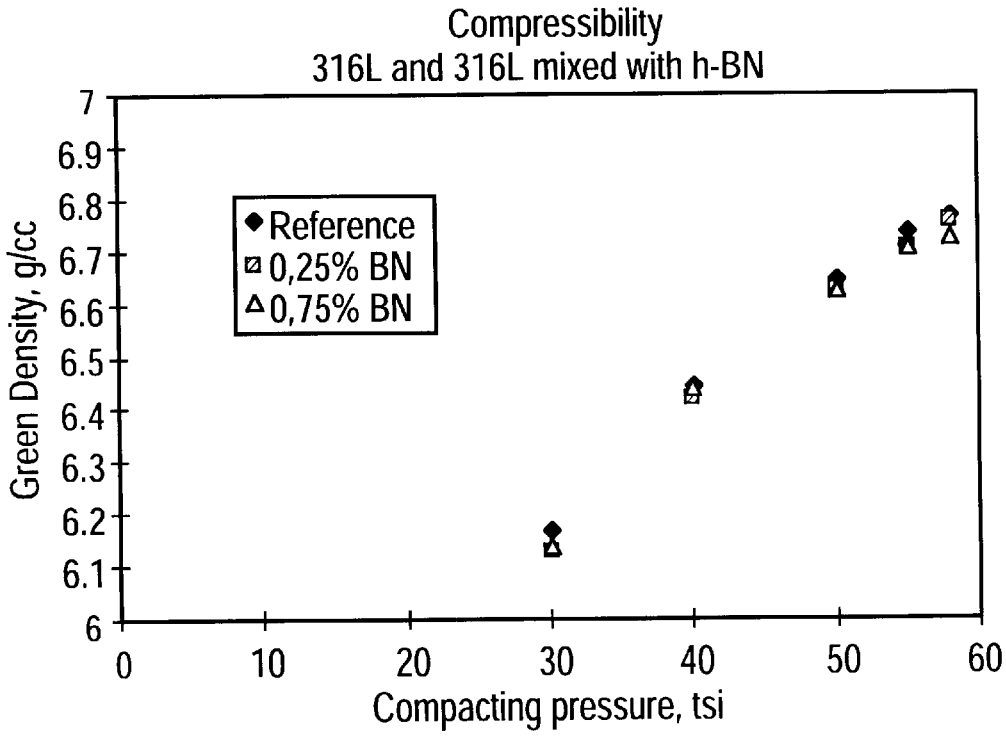
FIG. 4 is a diagram showing the compressibility of a commercial 316L steel powder mixed with h-BN powder according to the invention, together with a reference steel.
Figure 5:
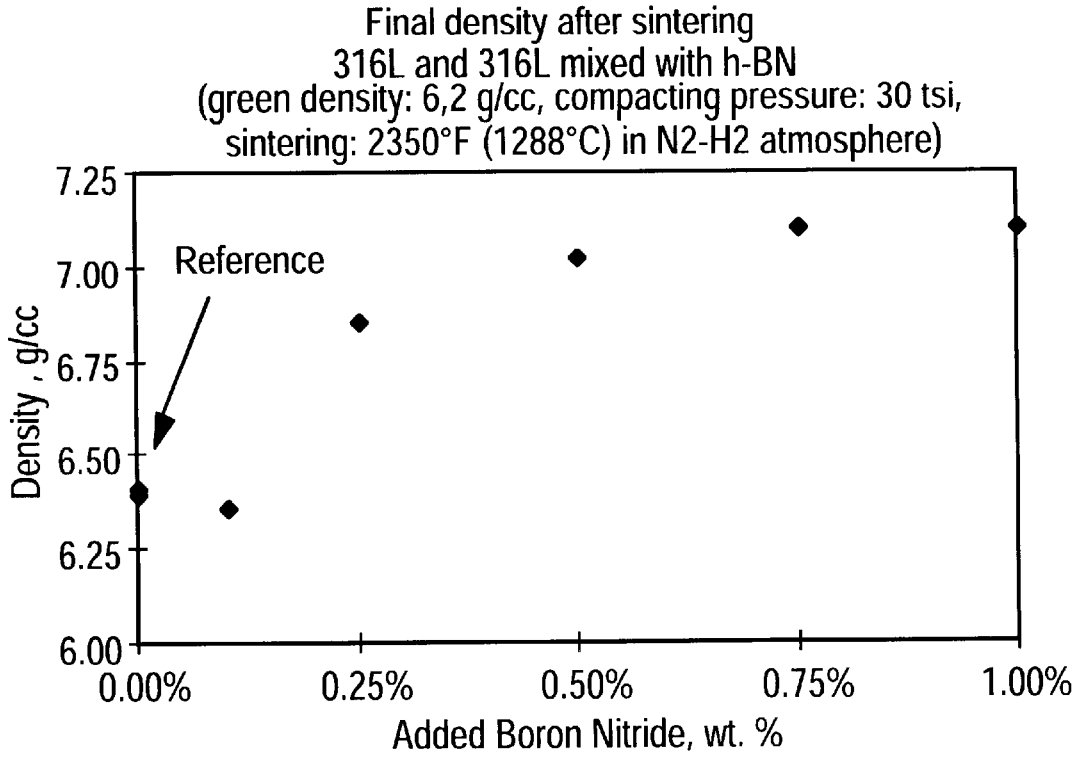
FIG. 5 is a diagram showing the final density after sintering of a P/M manufactured steel using h-BN powder mixed with 316L stainless steel powder according to the invention, together with a reference steel.
Figure 6:
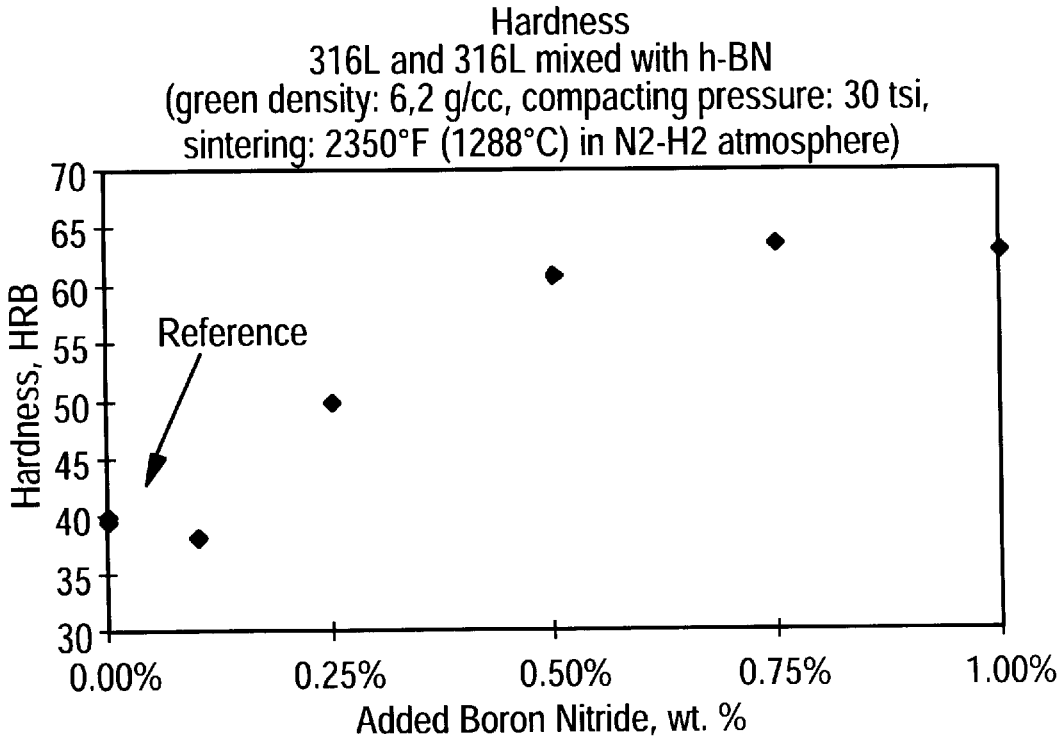
FIG. 6 is a diagram showing the hardness of a P/M manufactured steel using h-BN powder mixed with stainless steel powder according to the invention, together with a reference steel.

FIGS. 4 to 6 show the compressibility, density after sintering and hardness (Rockwell B Hardness, referred to as HRB henceforth) of sintered SS according to the invention, respectively. FIG. 4 shows the compressibility of a 316L stainless steel powder mixed with h-BN powder as a function of the compacting pressure, ranging from 30 tsi to about 58 tsi. Two different amounts of h-BN addition were investigated, 0.25% and 0.75%. Furthermore, reference tests were conducted at the same compacting pressures, using a SS without any h-BN.

In FIG. 5, the final density after sintering is shown, as a function of the amount of added h-BN powder. As is clearly seen, a maximum density value is reached at an approximate h-BN content of 0.75%.

In FIG. 6, the hardness is shown as a function of the amount of added h-BN. Also here, a maximum hardness is reached at a h-BN content around 0.75%.

Figure 7:
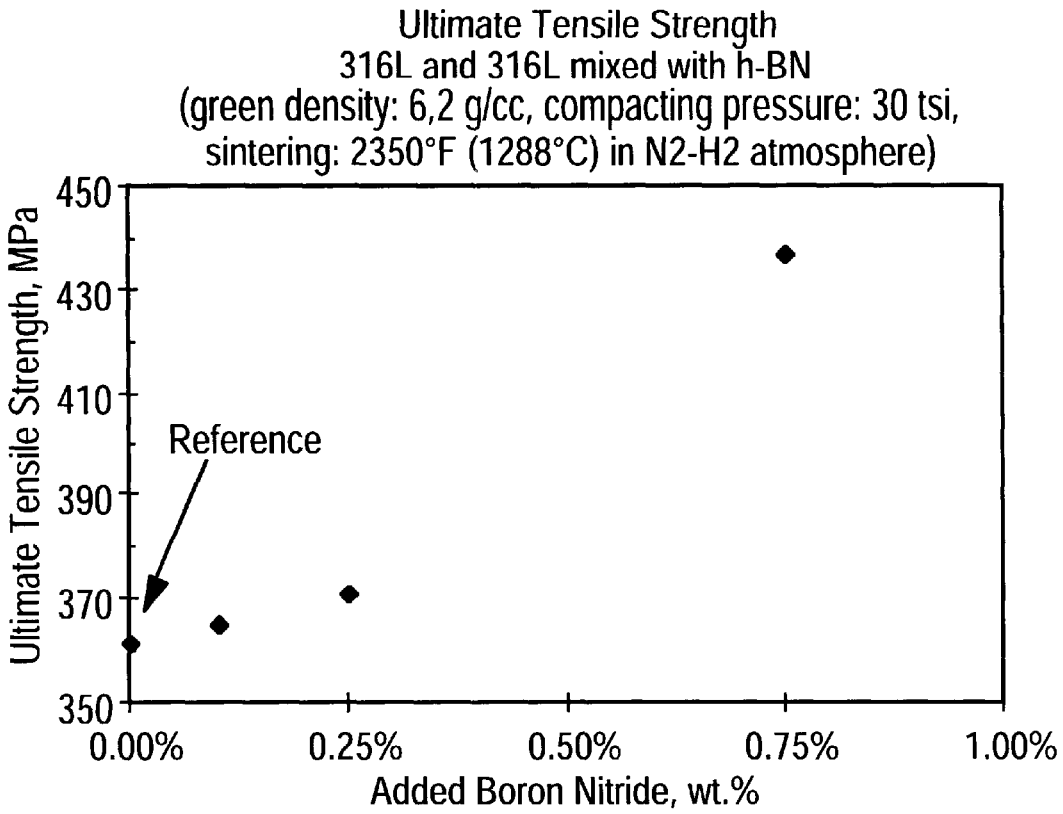
FIG. 7 is a diagram showing the ultimate tensile strength of a P/M manufactured steel using h-BN powder mixed with 316L stainless steel powder according to the invention, together with a reference steel.

FIG. 7 shows the ultimate tensile strength (in MPa) reached as a function of the h-BN content. The trend is that the tensile strength of the sintered material increases with the amount of added h-BN powder.

For comparison, the MPIF gives the standard values for hardness, density and ultimate strength listed in Table 2.

TABLE 2

| | Sintering parameters | Typical apparent hardness | Typical density ($g/cm^3$) | Ultimate strength MPa |
|---|---|---|---|---|
| SS-316L-15 | 2350° F. (1288° C.) in partial vacuum | 20 HRB | 6.6 | 283 |
| SS-316L-22 | 2350° F. (1288° C.) in partial vacuum | 45 HRB | 6.9 | 393 |

Figure 8:
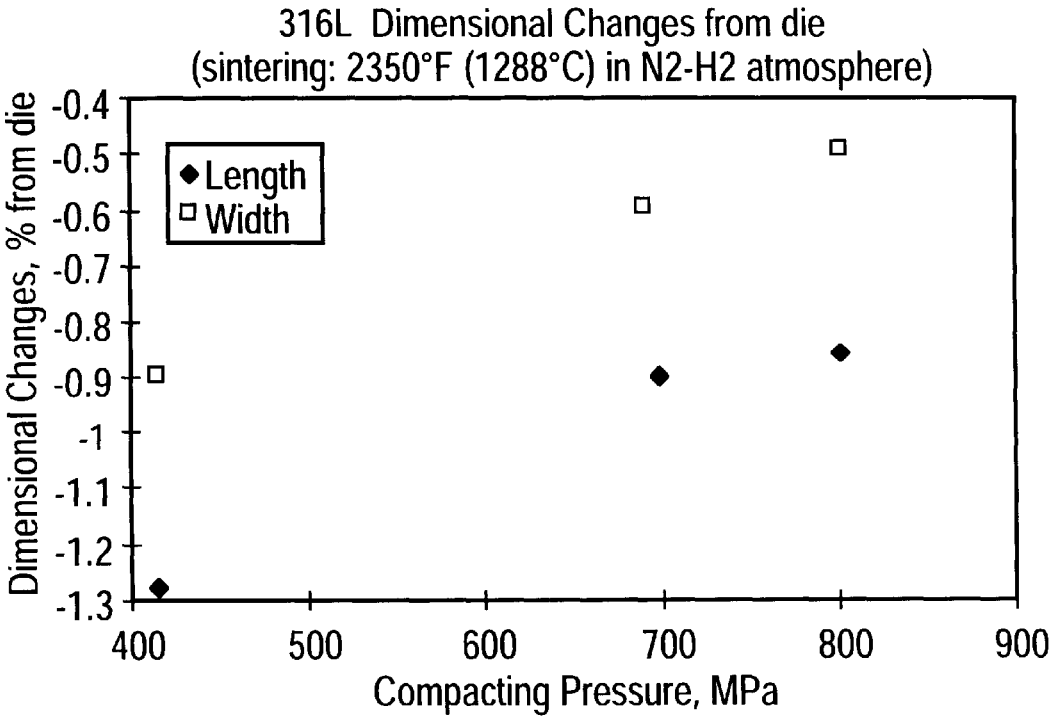
FIG. 8 is a diagram showing the dimensional changes of a reference steel as a function of the compacting pressure used to make green bodies.

FIG. 8 shows the dimensional changes of the 316L stainless steel sintered bodies, compared to the die dimensions.

Figure 9:
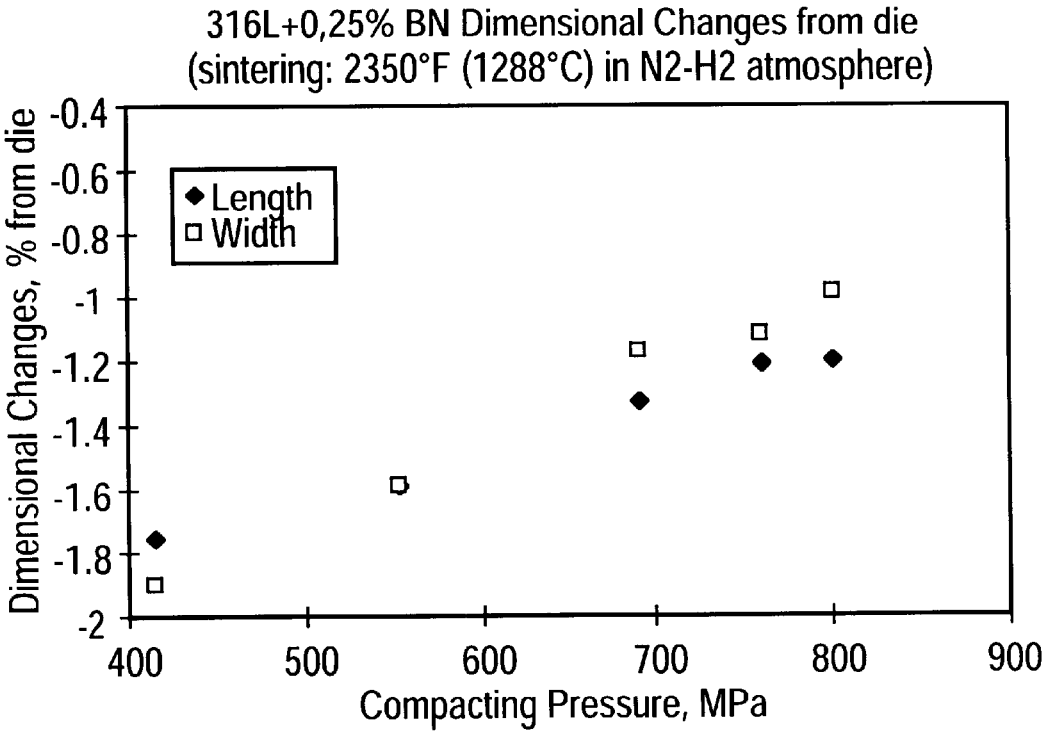
FIG. 9 is a diagram showing the dimensional changes of a P/M manufactured steel using h-BN mixed with 316L stainless steel powder according to the invention, as a function of the compacting pressure used to make green bodies.
Figure 10:
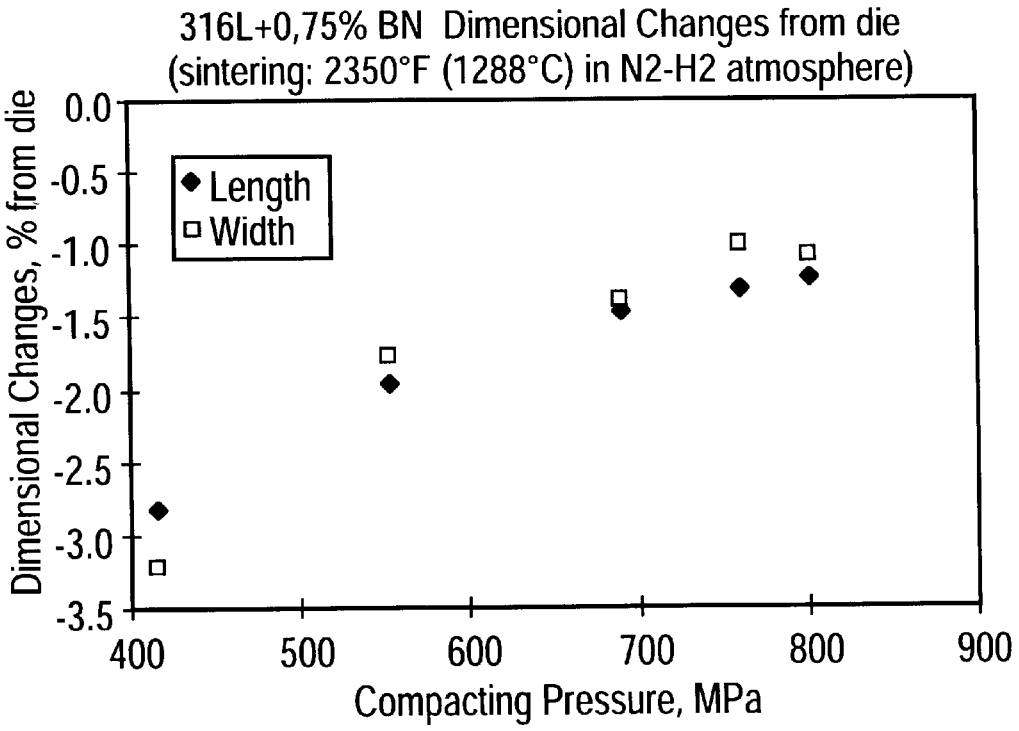
FIG. 10 is a diagram showing the dimensional changes of a further P/M manufactured steel using h-BN mixed with 316L stainless steel powder according to the invention, as a function of the compacting pressure used to make green bodies.
Figure 11:
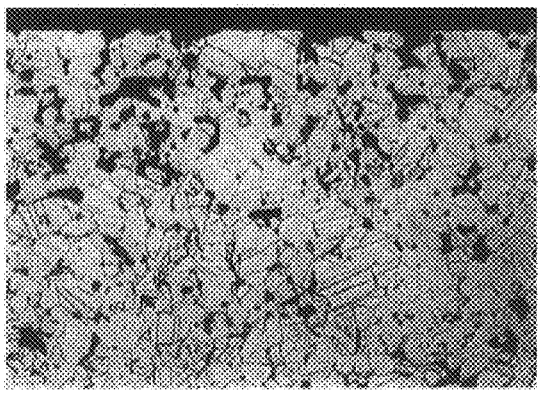
FIG. 11 is a diagram showing the etched surface microstructure of a reference 316L steel, at 200X magnification.
Figure 12:
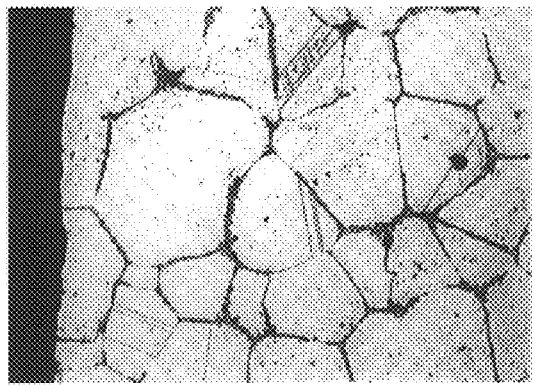
FIG. 12 is a diagram showing the etched surface microstructure of a further P/M manufactured steel using 0.75% h-BN powder mixed with 316L stainless steel powder according to the invention, at 200X magnification.
Figure 13:
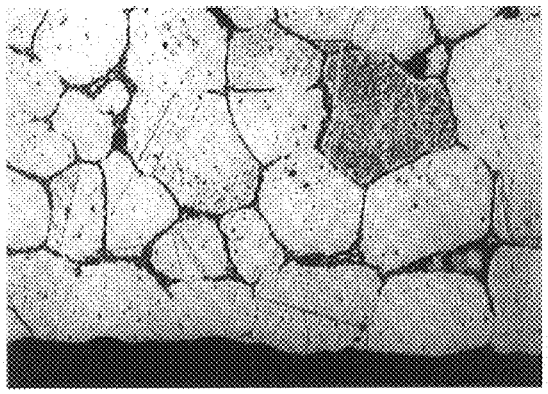
FIG. 13 is a diagram showing the etched surface microstructure of a further P/M manufactured steel using 1% h-BN powder mixed with 316L stainless steel powder according to the invention, at 200X magnification.

FIG. 9 is a diagram showing the dimensional changes of a P/M manufactured steel using h-BN powder mixed with stainless steel powder according to the invention, as a function of the compacting pressure used to make green bodies, FIG. 10 is a diagram showing the dimensional changes of a further P/M manufactured steel using h-BN powder mixed with stainless steel powder according to the invention, as a function of the compacting pressure used to make green bodies, FIGS. 11 to 13 illustrate the microstructure changes in a reference steel and a stainless steel according to the invention as a function of h-BN content. FIG. 11 shows the microstructure of a reference 316L stainless steel. The black fields within the etched surface are pores which negatively influence the mechanical properties of the steel, as well as contribute to a decreased corrosion resistance. FIGS. 12 and 13, show the surface microstructure of steels according to the invention. Notice how the porosity is reduced at the surface for higher h-BN contents. As clearly apparent, the surface porosity is much lower than that of the stainless steels according to FIG. 11, thus indicating that the P/M stainless steels according to the invention exhibit superior mechanical properties and corrosion resistance.

Corrosion results are shown in FIGS. 14 to 20. The salt spray tests were conducted according to the ASTM standard B117. Corrosion behavior was monitored daily except for weekends. The salt spray test is designed for wrought materials and is, therefore, too aggressive for P/M parts. Furthermore, there is no standard practice for evaluating the corrosion behavior of ferrous P/M parts. To avoid any ambiguity, the results indicate the number of samples (out of a total of 5 samples) that did not present any corrosion for the specified period. However, the fact that a sample is discarded at the first sign of corrosion does not mean that its over all corrosion resistance is not good. The Figures show the spray test results after 42, 67, 163, 188, 212, 236 and 376 hours respectively. In each Figure, five steel samples, of each of five different h-BN addition amount groups of steels, were tested and the number of samples without any corrosion traces are shown for each h-BN addition amount.

Figure 14:
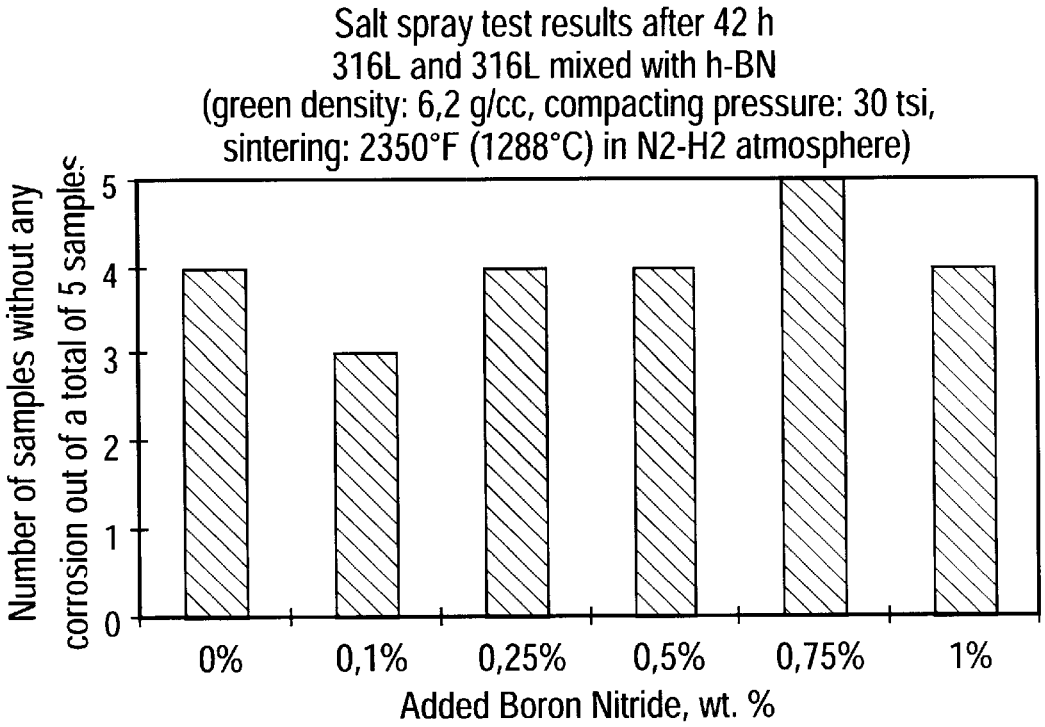
FIG. 14 is a diagram showing the result of a corrosion test after 42 hours on a P/M manufactured steel using h-BN powder mixed with 316L stainless steel powder according to the invention, together with reference steels.
Figure 15:
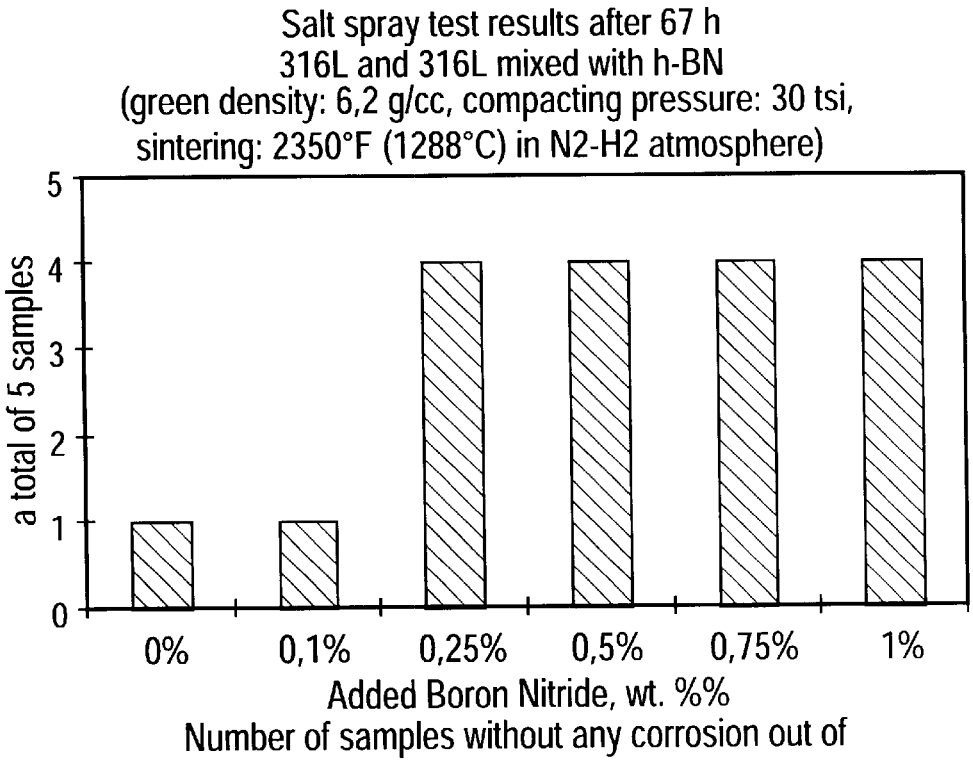
FIG. 15 is a diagram showing the result of a corrosion test after 67 hours on a P/M manufactured steel using h-BN powder mixed with 316L stainless steel powder according to the invention, together with reference steels.

As shown in FIG. 14, there was no great difference between samples from different h-BN addition groups after 42 hours of testing. After 67 hours, as is shown in FIG. 15, four out of five samples that were not within the composition of the invention, but had no h-BN addition or a low h-BN addition of 0.1%, showed corrosion.

Figure 16:
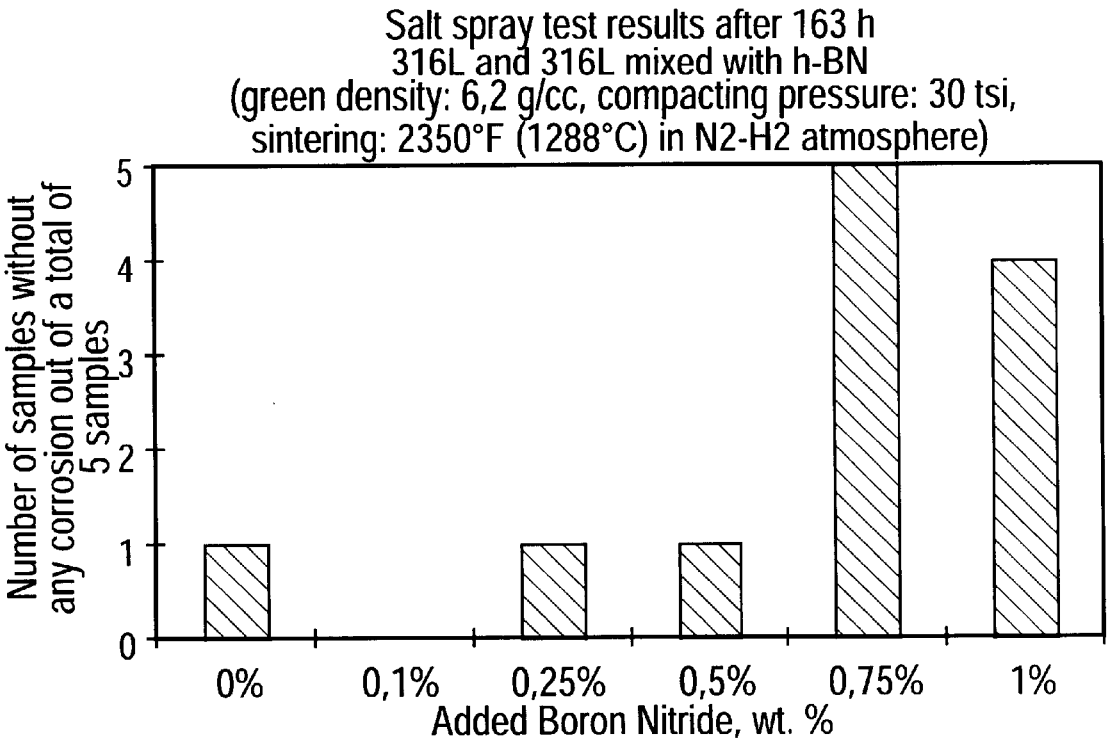
FIG. 16 is a diagram showing the result of a corrosion test after 163 hours on a P/M manufactured steel using h-BN powder mixed with 316L stainless steel powder according to the invention, together with reference steels.
Figure 17:
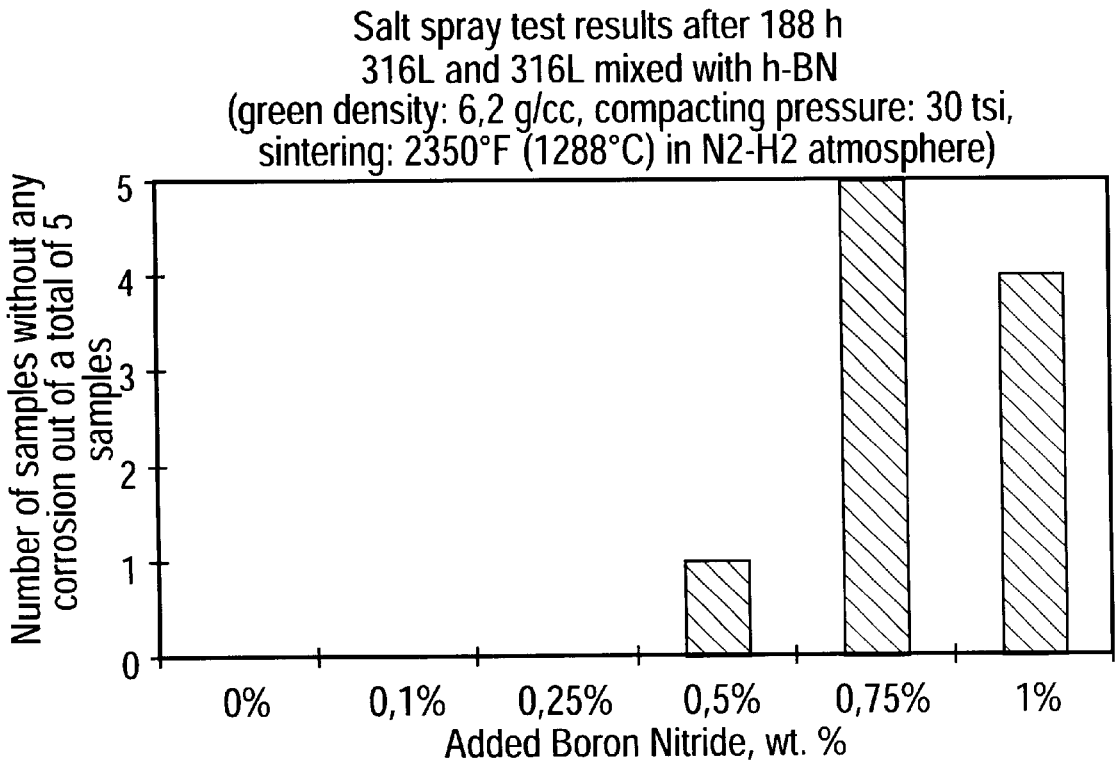
FIG. 17 is a diagram showing the result of a corrosion test after 188 hours on a P/M manufactured steel using h-BN powder mixed with 316L stainless steel powder according to the invention, together with reference steels.
Figure 18:
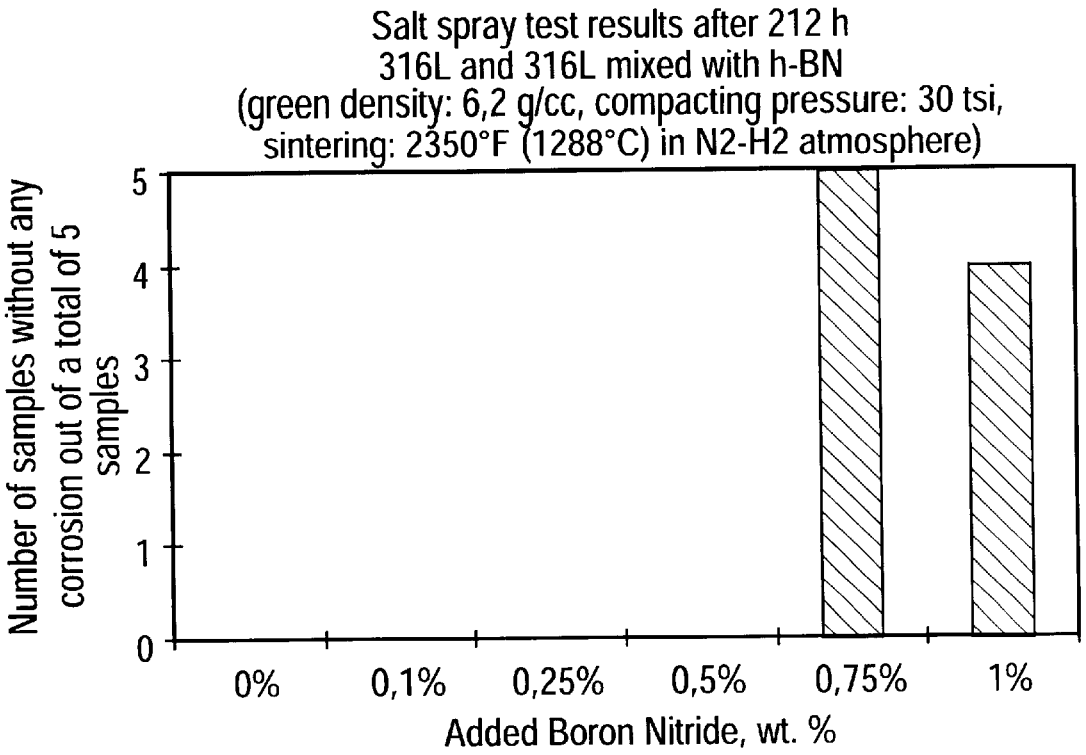
FIG. 18 is a diagram showing the result of a corrosion test after 212 hours on a P/M manufactured steel using h-BN powder mixed with 316L stainless steel powder according to the invention, together with reference steels.
Figure 19:
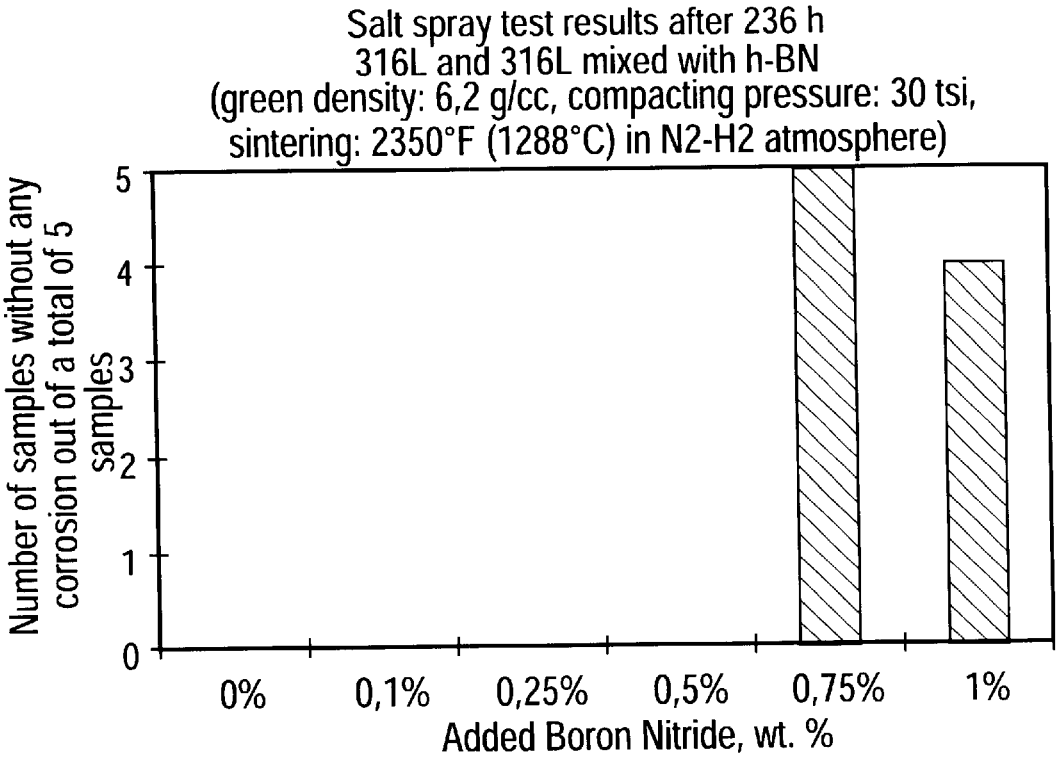
FIG. 19 is a diagram showing the result of a corrosion test after 236 hours on a P/M manufactured steel using h-BN powder mixed with 316L stainless steel powder according to the invention, together with reference steels.
Figure 20:
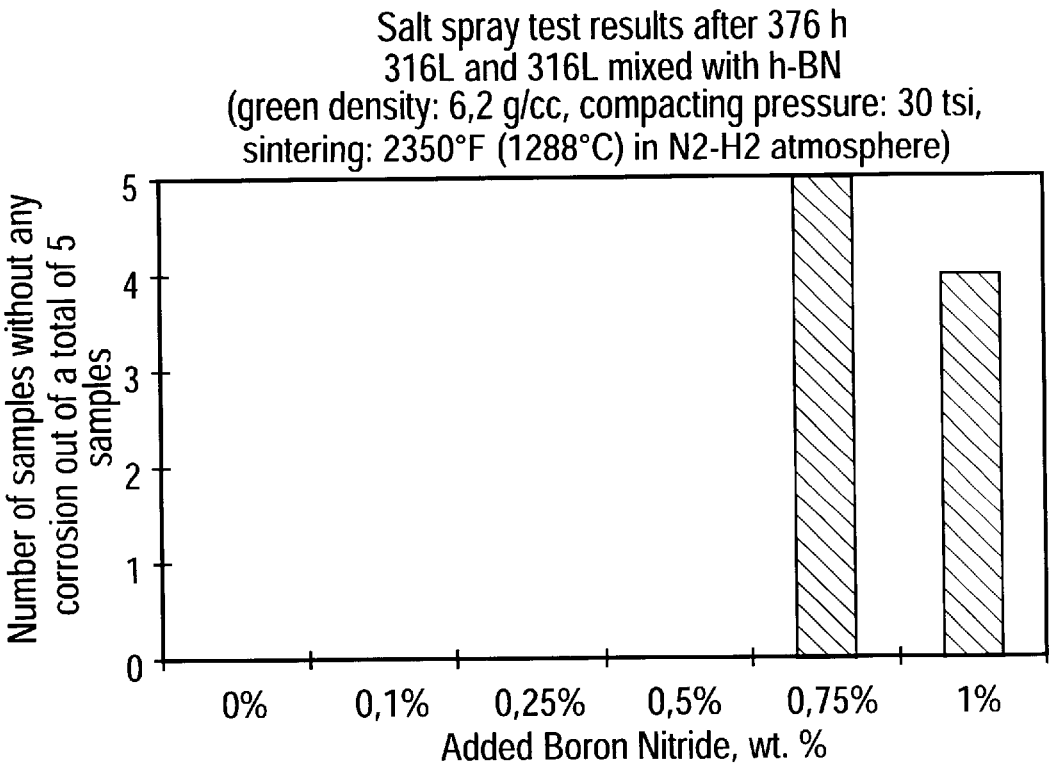
FIG. 20 is a diagram showing the result of a corrosion test after 376 hours on a P/M manufactured steel using h-BN powder mixed with 316L stainless steel powder according to the invention, together with reference steels.

FIG. 16 shows the result after 163 hours of testing, only one sample having 0.75% h-BN addition or 1% h-BN addition exhibit an unaffected surface regarding corrosion. At this stage, also samples having 0.5% h-BN addition are corroded to an extent of four out of five samples.

FIGS. 17 to 20 underline the high corrosion resistance of the samples having 0.75% h-BN addition and 1% h-BN addition. Only one sample out of ten showed any corrosion after 188, 212, 236 or 376 hours of testing, respectively.

EXAMPLE C

Commercial 304L type austenitic stainless steel powder was mixed with commercial h-BN powder. The method of making the sintered bodies of stainless steel included the following steps:

a) Commercial h-BN powder was added to, and mixed with commercial stainless steel powder, in the weight percentage range 0–1%.

b) Powder bodies were compacted using a pressure in the range of 20–60 tsi (276–828 MPa) to form green bodies.

c) The green bodies were sintered in a Hydrogen-Nitrogen atmosphere at a sintering temperature range of 2000° (1093° C.)–2400° F. (1316° C.) and during a sintering time of between 15–60 minutes.

According to the MPIF Standard, the 304L austenitic stainless steel should have the composition listed in Table 3. Hence, in the case of mixing h-BN powder to the SS-304L powder, the end product remains within the composition range of the MPIF 304L standard.

TABLE 3

| Element | C | Cr | Ni | Mn | Si | P | S | N | Fe |
|---|---|---|---|---|---|---|---|---|---|
| Minimum | 0.0 | 18 | 8 | 0.0 | 0.0 | 0.0 | 0.0 | 0.00 | Bal. |
| Maximum | 0.03 | 20 | 12 | 2.0 | 1.0 | 0.045 | 0.03 | 0.03 | Bal. |

Other elements: Total by difference equals 2.0% maximum which may include other minor elements added for specific purposes.

Figure 21:
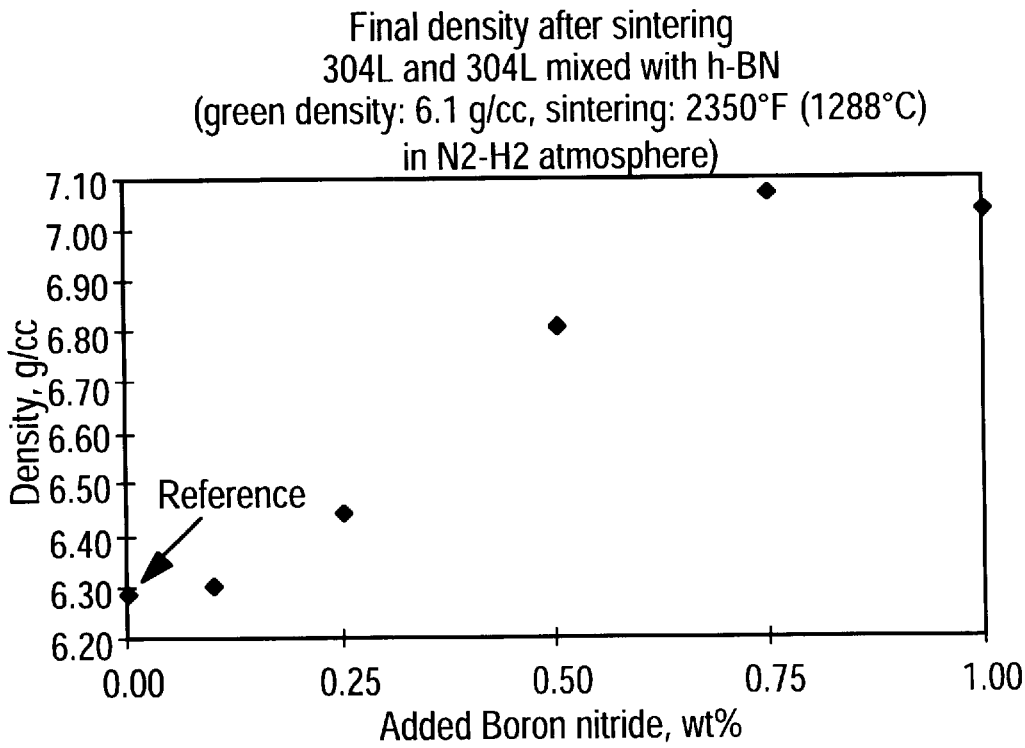
FIG. 21 is a diagram showing the final density after sintering of a further manufactured steel using h-BN powder mixed with 304L stainless steel powder according to the invention, together with a reference steel.
Figure 22:
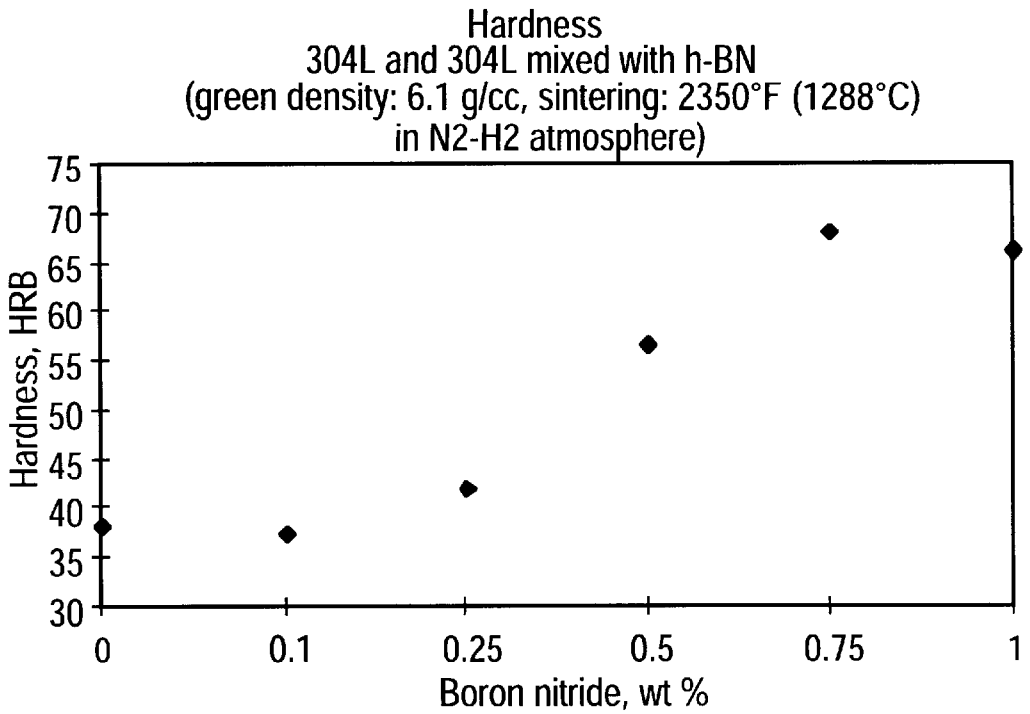
FIG. 22 is a diagram showing the hardness of a further P/M manufactured steel using h-BN powder mixed with 304L stainless steel powder according to the invention, together with a reference steel.

FIGS. 21 and 22 show final density after sintering and hardness (HRB) of sintered SS according to the invention, respectively. In FIG. 21, the final density after sintering is shown, as a function of the amount of added h-BN powder. A maximum density value is reached at an approximate h-BN content of 0.75%.

In FIG. 22, the hardness is shown as a function of the amount of added h-BN. Also here, a maximum hardness is reached at a h-BN content around 0.75%.

For comparison, the MPIF gives the standard values for hardness, density and ultimate strength listed in Table 4.

TABLE 4

| | Sintering parameters | Typical apparent hardness | Typical density ($g/cm^3$) | Ultimate strength MPa |
|---|---|---|---|---|
| SS-304L-13 | 2350° F. (1288° C.) in partial vacuum | 30 HRB | 6.6 | 296.5 |
| SS-304L-18 | 2350° F. (1288° C.) in partial vacuum | 45 HRB | 6.9 | 393 |

Figure 23:
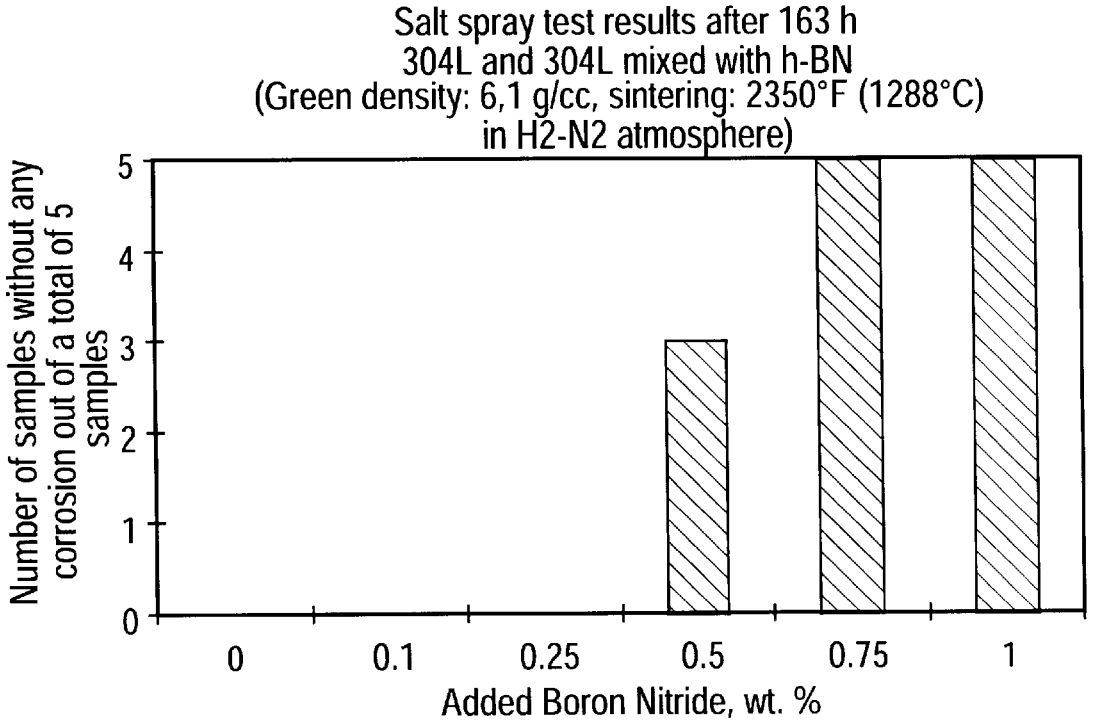
FIG. 23 is a diagram showing the result of a corrosion test after 163 hours on a further P/M manufactured stainless steel using h-BN powder mixed with 304L stainless steel powder according to the invention, together with a reference steel.
Figure 24:
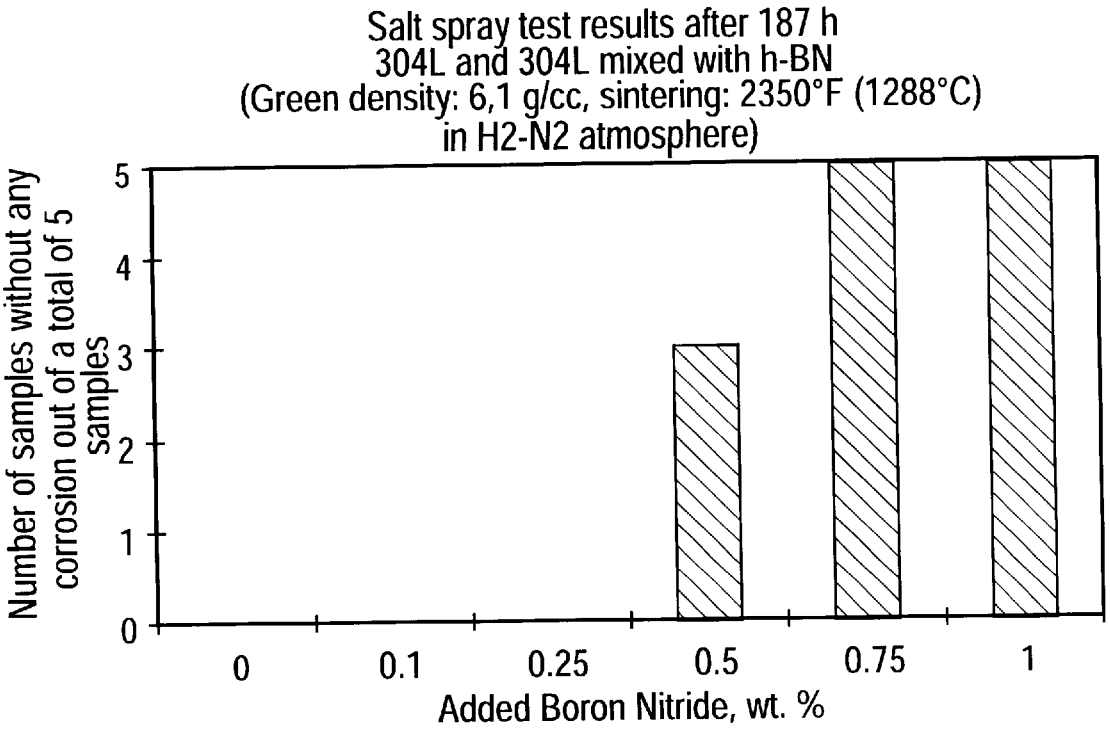
FIG. 24 is a diagram showing the result of a corrosion test after 187 hours on a further P/M manufactured stainless steel using h-BN powder mixed with 304L stainless steel powder according to the invention, together with a reference steel.
Figure 25:
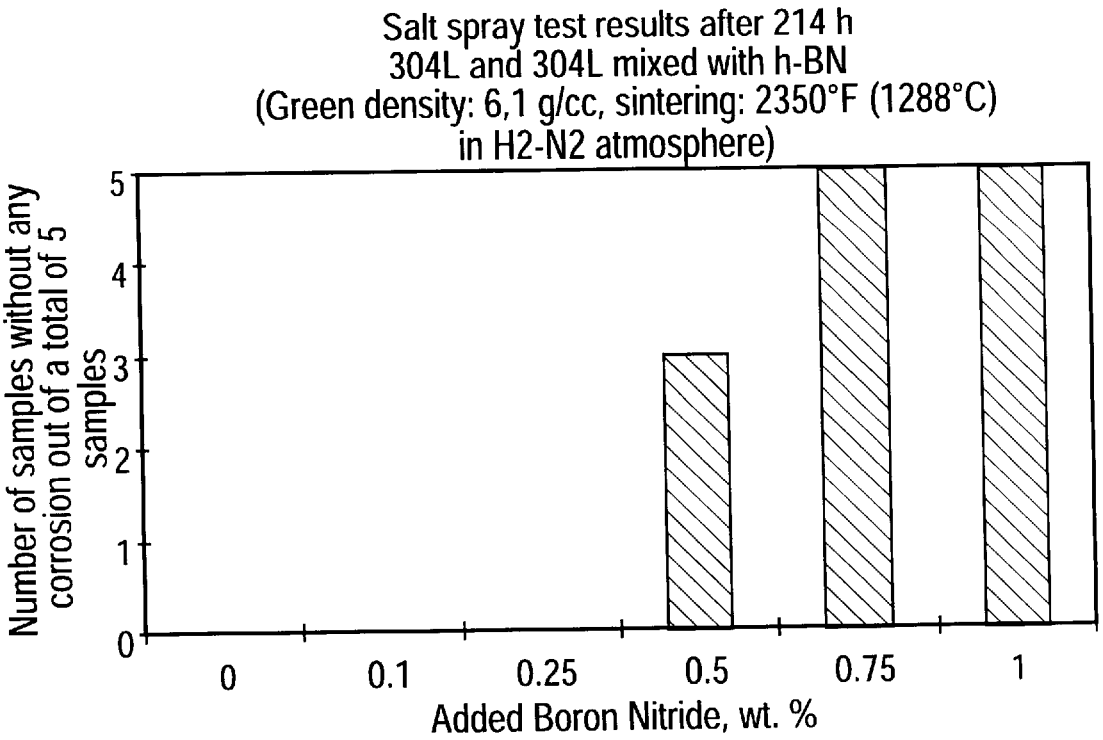
FIG. 25 is a diagram showing the result of a corrosion test after 214 hours on a further P/M manufactured stainless steel using h-BN powder mixed with 304L stainless steel powder according to the invention, together with reference steel.

Corrosion results are shown in FIGS. 23 to 25. The salt spray tests were conducted according to the ASTM standard B117. Corrosion behavior was monitored daily except for weekends. The salt spray test is designed for wrought materials and is, therefore, too aggressive for P/M parts. Furthermore, there is no standard practice for evaluating the corrosion behavior of ferrous P/M parts. To avoid any ambiguity, the results indicate the number of samples (out of a total of 5 samples) that did not present any corrosion for the specified period. However, the fact that a sample is discarded at the first sign of corrosion does not mean that its over all corrosion resistance is not good. The Figures show the spray test results after 163,187 and 214 hours respectively. In each Figure, five steel samples, of each of five different h-BN addition amount groups of steels, were tested and the number of samples without any corrosion traces are shown for each h-BN addition amount.

FIG. 23 shows the result after 163 hours of testing, only the samples having 0.75% h-BN addition or 1% h-BN addition exhibit an unaffected surface regarding corrosion while all the reference samples and those containing 0.1% and 0.25% h-BN have corroded. Samples having 0.5% h-BN addition are corroded to an extend of two out of five samples.

FIGS. 24 and 25 underline the high corrosion resistance of the samples having 0.75% h-BN addition and 1% h-BN addition. No samples showed any corrosion after 187 and 214 hours of testing, respectively. Also the samples having 0.5% h-BN addition show a fair corrosion resistance with corrosion in two samples out of five.

No adverse effects are noticeable when adding more than 1% h-BN to the steel. To stay within the MPIF standard, a maximum of 2% of other elements is permissible, in addition to the specified alloying elements, limiting the h-BN addition to 2%. Thus, using one of the three described methods, pre-sintering impregnation/post-sintering impregnation/h-BN powder mixing with steel powder, sintered steels having a composition of essentially iron, and possible alloying elements such as chromium, molybdenum and nickel, together with 0.1 to 2% h-BN, preferably 0.7 to 1% h-BN, may be produced. These steels exhibit superior corrosion properties, compared to known P/M steels of the respective type. They also show increased hardness, tensile strength, free machining properties, tightness and surface density.

Figure 26:
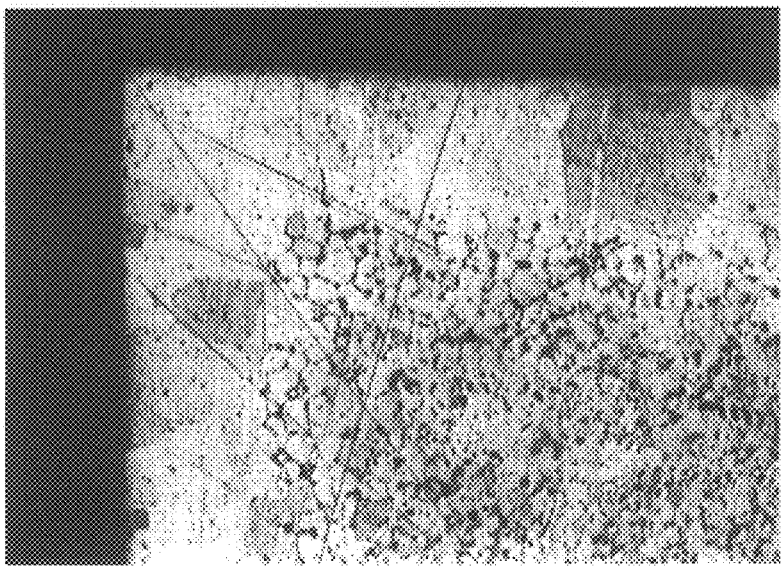
FIG. 26 is a diagram showing the etched surface microstructure of a P/M manufactured steel using h-BN powder mixed with 409Cb stainless steel powder according to the invention, at 50X magnification.

In FIG. 26, the microstructure of a P/M ferritic stainless steel of type 409CB, produced according to the invention using a 1% h-BN addition, is shown.

Immersion tests, as described earlier, resulted in the reference material of 409Cb P/M steel showing pitting corrosion after 0.5 hours, whilst the 409Cb steel according to the invention showed no signs of corrosion after more than 69 hours.

Figure 27:
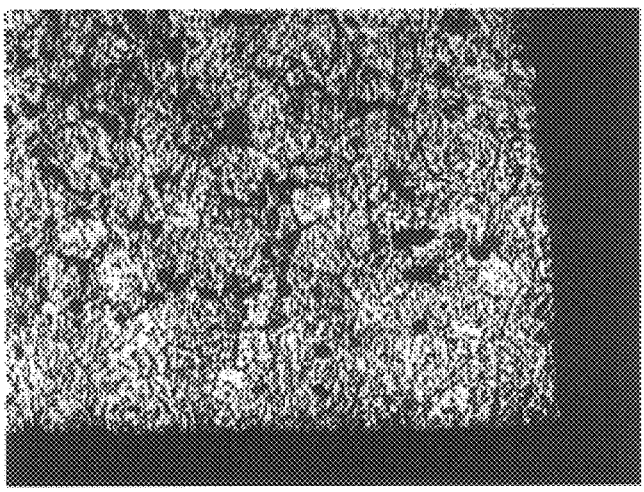
FIG. 27 is diagram showing the etched surface microstructure of a P/M manufactured steel using h-BN powder mixed with conventional carbon steel powder according to the invention, at 100X magnification.

In FIG. 27, the microstructure of a P/M carbon steel, produced according to the invention using a 1% h-BN addition, is shown. Also this type of steel exhibits a surface densification resulting in an increase of the corrosion resistance, tensile strength, hardness, tightness and impact properties compared to P/M carbon steels without the h-BN addition.

Even pure iron produced by P/M (according to the invention), exhibits a surface densification resulting in better mechanical properties and increased corrosion resistance.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. A method of enhancing corrosion resistance of sintered steel bodies, the method comprising the body production steps of:

a) Adding h-BN powder to, and mixing with, a steel powder, in the weight percentage range 0.1 to 2%;

b) Compacting the mixed steel powder/h-BN powder using a pressure to form green bodies;

c) Sintering the green bodies to produce sintered steel bodies, having a densified surface layer.

2. The method as recited in claim 1, wherein said pressure is in the range of 20 to 60 tsi (276 to 828 MPa), and wherein said sintering is performed at a sintering temperature range of 2350° F. (1288° C.) To 2500° F. (1371° C.) And for a time of between 15 to 60 minutes.

3. The method as recited in claim 1, wherein said compacting step b) is performed by metal injection molding (MIM) the green bodies.

4. The method as recited in claim 1, wherein the h-BN powder is added in the weight percentage 0.7 to 1%.

5. The method as recited in claim 2, wherein the h-BN powder is added in the weight percentage 0.7 to 1%.

6. The method as recited in claim 3, wherein the h-BN powder is added in the weight percentage 0.7 to 1%.

7. The method as recited in claim 1, wherein the steel powder is a stainless steel powder.

8. The method as recited in claim 2, wherein the steel powder is a stainless steel powder.

9. The method as recited in claim 3, wherein the steel powder is a stainless steel powder.

10. The method as recited in claim 1, wherein the sintering step is performed in an atmosphere comprising a mixture of hydrogen and nitrogen.

11. The method as recited in claim 2, wherein the sintering step is performed in an atmosphere comprising a mixture of hydrogen and nitrogen.

12. The method as recited in claim 3, wherein the sintering step is performed in an atmosphere comprising a mixture of hydrogen and nitrogen.

13. A method of enhancing corrosion resistance of sintered steel bodies, the method comprising the body production steps of:

a) Compacting steel powder using a pressure to form green bodies;

b) Impregnating the green bodies with a solution containing h-BN;

c) Sintering the impregnated green bodies to produce sintered steel bodies, having a densified surface layer.

14. The method as recited in claim 13, wherein said pressure is in the range of 20 to 60 tsi (276 to 828 MPa), and wherein said sintering is performed at a sintering temperature range of 2350° F. to 2500° F. (1288° C. to 1371° C.) and for a time of between 15 to 60 minutes.

15. The method as recited in claim 13, wherein said compacting step a) is performed by metal injection molding the green bodies and a pre-sintering step is performed before step b), to remove a binder mixture used for the metal injection molding step.

16. The method as recited in claim 13, wherein said steel powder is a stainless steel powder.

17. The method as recited in claim 14, wherein said steel powder is a stainless steel powder.

18. The method as recited in claim 15, wherein said steel powder is a stainless steel powder.

19. The method as recited in claim 13, wherein said sintering step is performed in an atmosphere comprising a mixture of hydrogen and nitrogen.

20. The method as recited in claim 14, wherein said sintering step is performed in an atmosphere comprising a mixture of hydrogen and nitrogen.

21. The method as recited in claim 15, wherein said sintering step is performed in an atmosphere comprising a mixture of hydrogen and nitrogen.

22. A method of enhancing corrosion resistance of sintered steel bodies, the method comprising the body production steps of:

a) Compacting a steel powder using a pressure to form green bodies;

b) Pre-sintering the green bodies;

c) Impregnating the pre-sintered steel bodies with a solution containing h-BN to produce sintered steel bodies, having a densified surface layer;

d) Sintering the impregnated bodies.

23. The method as recited in claim 22, wherein said pressure is in the range of 20 to 60 tsi (276 to 828 MPa), and wherein said sintering is performed at a sintering temperature range of 2350° F. to 2500° F. (1288° C. to 1371° C.) and for a time of between 15 to 60 minutes.

24. The method as recited in claim 22, wherein said compacting step a) is performed by metal injection molding (MIM) the green bodies.

25. The method as recited in claim 22, wherein said steel powder is a stainless steel powder.

26. The method as recited in claim 23, wherein said steel powder is a stainless steel powder.

27. The method as recited in claim 24, wherein said steel powder is a stainless steel powder.

28. The method as recited in claim 22, wherein said sintering step is performed in an atmosphere comprising a mixture of hydrogen and nitrogen.

29. The method as recited in claim 23, wherein said sintering step is performed in an atmosphere comprising a mixture of hydrogen and nitrogen.

30. The method as recited in claim 24, wherein said sintering step is performed in an atmosphere comprising a mixture of hydrogen and nitrogen.

31. A method of enhancing corrosion resistance of sintered steel bodies, the method comprising the body production steps of:

a) Compacting a steel powder using a pressure to form green bodies;

b) Sintering said green bodies;

c) Impregnating said green bodies with a solution containing h-BN to produce sintered steel bodies, having a densified surface layer.

32. The method as recited in claim 31, wherein said pressure is in the range of 20 to 60 tsi (276 to 828 MPa), and the sintering is performed at a sintering temperature range of 2350° F. to 2500° F. (1288° C. to 1371° C.) and for a time of between 15 to 60 minutes.

33. The method as recited in claim 31, wherein said compacting step a) is performed by metal injection molding (MIM) the green bodies.

34. The method as recited in claim 31, wherein said steel powder is a stainless steel powder.

35. The method as recited in claim 32, wherein said steel powder is a stainless steel powder.

36. The method as recited in claim 33, wherein said steel powder is a stainless steel powder.

37. The method as recited in claim 31, wherein said sintering step is performed in an atmosphere comprising a mixture of hydrogen and nitrogen.

38. The method as recited in claim 32, wherein said sintering step is performed in an atmosphere comprising a mixture of hydrogen and nitrogen.

39. The method as recited in claim 33, wherein said sintering step is performed in an atmosphere comprising a mixture of hydrogen and nitrogen.

40. The method as recited in claim 31, wherein a further step is added after step c), said further step comprising heating said impregnated bodies.

41. The method as recited in claim 40, wherein said further step comprises heating at a temperature of 100 to 300° C.

42. The method as recited in claim 40, wherein said further step comprises heating at a temperature of normal sintering temperature level.

43. A sintered steel composed essentially of iron and chromium, the steel further containing 0.1 to 2% h-BN, said steel further having a densified surface layer.

44. A sintered steel as recited in claim 43, wherein said steel is a stainless steel.

45. A sintered steel as recited in claim 43, said steel containing 0.7 to 1% h-BN.

46. A sintered steel as recited in claim 45, wherein said steel is a stainless steel.

47. A sintered steel composed essentially of iron, chromium and nickel, the steel further containing 0.1 to 2% h-BN, said steel further having a densified surface layer.

48. A sintered steel as recited in claim 47, wherein said steel is a stainless steel.

49. A sintered steel as recited in claim 43, the steel containing 0.7 to 1% h-BN.

50. A sintered steel as recited in claim 49, wherein said steel is a stainless steel.

* * * * *